US009951576B2

(12) United States Patent
Bergeron

(10) Patent No.: US 9,951,576 B2
(45) Date of Patent: Apr. 24, 2018

(54) LOCKDOWN FOR HIGH PRESSURE WELLHEAD

(71) Applicant: Chevron U.S.A. Inc., San Ramon, CA (US)

(72) Inventor: Henry Anthony Bergeron, Houston, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 17 days.

(21) Appl. No.: 14/994,877

(22) Filed: Jan. 13, 2016

(65) Prior Publication Data

US 2017/0198541 A1 Jul. 13, 2017

(51) Int. Cl.

| | |
|---|---|
| ***E21B 33/035*** | (2006.01) |
| ***E21B 33/038*** | (2006.01) |
| ***E21B 23/04*** | (2006.01) |
| ***E21B 33/043*** | (2006.01) |
| ***F16L 35/00*** | (2006.01) |
| ***E21B 33/04*** | (2006.01) |
| ***E21B 17/08*** | (2006.01) |

(52) U.S. Cl.
CPC ..... *E21B 33/035* (2013.01); *E21B 33/038* (2013.01)

(58) Field of Classification Search
None
See application file for complete search history.

(56) References Cited

U.S. PATENT DOCUMENTS

| | | | | |
|---|---|---|---|---|
| 4,653,778 | A | 3/1987 | Alandy | |
| 5,188,180 | A * | 2/1993 | Jennings | E21B 23/04 166/338 |
| 5,791,418 | A * | 8/1998 | Milberger | E21B 33/043 166/334.4 |
| 6,260,624 | B1 * | 7/2001 | Pallini, Jr. | E21B 33/038 166/345 |
| 6,386,291 | B1 * | 5/2002 | Short | E21B 33/0355 166/285 |
| 7,028,777 | B2 * | 4/2006 | Wade | E21B 33/043 166/341 |

* cited by examiner

*Primary Examiner* — Matthew R Buck
*Assistant Examiner* — Douglas S Wood
(74) *Attorney, Agent, or Firm* — King & Spalding LLP

(57) ABSTRACT

A lockdown tool for locking down a high pressure wellhead with a conductor wellhead housing includes a housing that includes a conductor wellhead housing facing surface designed to come in contact with a conductor wellhead housing positioned at or near a seafloor. The housing further includes a lockdown mechanism facing surface designed to come in contact with a lockdown mechanism that is between the conductor wellhead housing and a high pressure wellhead seated in the conductor wellhead housing. The housing also includes a wellhead facing surface having a profile that matches a profile of the high pressure wellhead formed on an outer surface of the high pressure wellhead. The lockdown tool further includes a piston positioned in a cavity of the housing and a hydraulic pressure port extending through a wall of the housing for applying hydraulic pressure by an external hydraulic pressure source into the cavity of the housing.

20 Claims, 11 Drawing Sheets

LOCKDOWN FOR HIGH PRESSURE WELLHEAD

TECHNICAL FIELD

The present application is generally related to running a mudline closure device (MCD), and in particular to a running tool and a running process for running an MCD and a high pressure wellhead to or near a seafloor in a single trip, and an associated lockdown tool and process.

BACKGROUND

A typical process of running an MCD involves a number of steps. To illustrate, a typical process may involve drilling a conductor hole to a desired depth and coupling a number of casings together to have a needed casing length. After the needed length of a casing is assembled, a high pressure wellhead is connected to the top joint of the casing. A running tool, designed for running the high pressure wellhead, is connected to the high pressure wellhead to run the high pressure wellhead to a conductor wellhead housing at the seafloor. To illustrate, a running string, which can consist of drill pipe or a thicker wall higher tensile strength pipe, may be attached to the running tool used to run the high pressure wellhead. The high pressure wellhead, along with the attached casing, is lowered to or near the seafloor where the high pressure wellhead is placed in the conductor wellhead.

After placement of the high pressure wellhead with the attached casing on the conductor wellhead housing, the casing is cemented in place by pumping cement down through the running string, where some of the cement returns to the sea floor on the outside of the casing. After the running tool used to run the high pressure wellhead is released from the high pressure wellhead and pulled from the seafloor back to the surface, and after the cement that is pumped down has time to harden, the MCD is run and connected to the high pressure wellhead that is seated in the conductor wellhead housing. The MCD is then pressure and function tested. The separate steps of running the high pressure wellhead and running the MCD, as well as the time for hardening of the pumped down cement, can take multiple days and can be expensive.

Further, a typical process of actuating a locking mechanism that is between the conductor wellhead housing and high pressure wellhead uses a lockdown tool that slips over the outside of the high pressure wellhead. To illustrate, after the lockdown tool is placed over the outside of the high pressure wellhead, tension is applied to the lockdown tool to latch and pre-load the high pressure wellhead to the conductor wellhead. The conductor wellhead housing and the high pressure wellhead are then held in place by the actuated lockdown mechanism. After the pre-loading process is completed, the lockdown tool is recovered to the surface (e.g., the offshore rig). Because the lockdown tool is placed over the top of the high pressure wellhead and then is slipped off the high pressure wellhead, the lockdown tool prevents running other equipment, such as an MCD, attached to the top of the high pressure wellhead in the same step as the running of the high pressure wellhead.

Thus, a running tool assembly, system, and process for running the MCD along with the high pressure wellhead and casing in a single trip can save time and reduce cost. Further, a lockdown tool and process that allow equipment that attaches to the high pressure wellhead to be run at the same time as the high pressure wellhead can save time and reduce cost.

SUMMARY

The present application is generally related to running a mudline closure device (MCD), and in particular to a running tool and a running process for running an MCD and a high pressure wellhead to a seafloor in a single trip and an associated lockdown tool and process.

In an example embodiment, A lockdown tool for locking down a high pressure wellhead with a conductor wellhead housing includes a housing that includes a conductor wellhead housing facing surface designed to come in contact with a conductor wellhead housing positioned at or near a seafloor. The housing further includes a lockdown mechanism facing surface designed to come in contact with a lockdown mechanism that is between the conductor wellhead housing and a high pressure wellhead seated in the conductor wellhead housing. The housing also includes a wellhead facing surface having a profile that matches a profile of the high pressure wellhead formed on an outer surface of the high pressure wellhead. The lockdown tool further includes a piston positioned in a cavity of the housing and a hydraulic pressure port extending through a wall of the housing for applying hydraulic pressure by an external hydraulic pressure source into the cavity of the housing.

In another example embodiment, a method of actuating a lockdown mechanism positioned between a high pressure wellhead and conductor wellhead housing includes attaching a lockdown tool to a high pressure wellbore, where the lockdown tool is annularly positioned around the high pressure wellbore. The method further includes running the high pressure wellhead to a seafloor along with the lockdown tool and positioning the high pressure wellhead in a conductor wellhead housing positioned at the seafloor. The method also includes applying hydraulic pressure to a cavity of the lockdown tool.

In another example embodiment, an offshore running and preloading system includes a running tool assembly for running a high pressure wellhead and a mudline closure device (MCD) to or near a seafloor. The running tool assembly includes an upper pipe and a test plug release mechanism detachably coupled in the running tool assembly. The running tool assembly further includes an inner diameter isolation tool and a test plug designed to be attached to a high pressure wellhead. The running tool assembly also includes a lower pipe. The offshore running and preloading system further includes a lockdown tool for locking down the high pressure wellhead with a conductor wellhead housing. The lockdown tool includes a housing. The housing includes a conductor wellhead housing facing surface designed to come in contact with the conductor wellhead housing positioned at or near the seafloor. The housing further includes a lockdown mechanism facing surface designed to come in contact with a lockdown mechanism that is at least partially positioned between the conductor wellhead housing and a high pressure wellhead seated in the conductor wellhead housing. The housing also includes a wellhead facing surface having a profile that matches a profile of the high pressure wellhead formed on an outer surface of the high pressure wellhead. The lockdown tool further includes a piston positioned in a cavity of the housing and a hydraulic pressure port extending through a wall of the housing for applying hydraulic pressure by an external hydraulic pressure source into the cavity of the housing.

These and other aspects, objects, features, and embodiments will be apparent from the following description and the appended claims.

BRIEF DESCRIPTION OF THE DRAWINGS

Reference will now be made to the accompanying drawings, which are not necessarily drawn to scale, and wherein.

Figure 1:
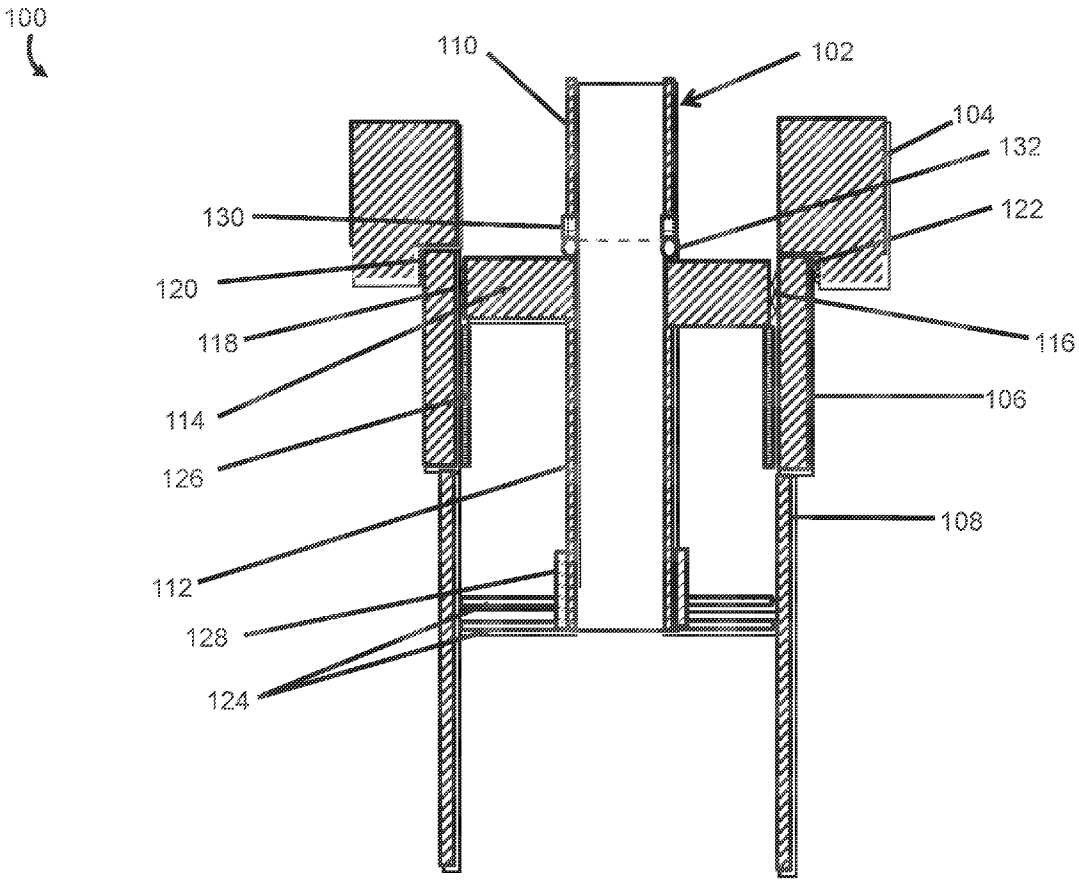
FIG. 1 illustrates a cross-sectional view of a running tool assembly attached to a high pressure wellhead for running a mudline closure device (MCD) and the high pressure wellhead according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, reference numerals designate like or corresponding, but not necessarily identical, elements.

DETAILED DESCRIPTION OF THE EXAMPLE EMBODIMENTS

The devices and methods of the present application include a running tool assembly for running, in a single trip, a high pressure wellhead and a mudline closure device (MCD) to a conductor wellhead housing that is, for example, at or near a seafloor. In some applications, an MCD may be used in conjunction with a blow-out-preventer (BOP). The MCD is typically attached to the top of high pressure wellhead and subsequently tested. The high pressure wellhead is positioned in a conductor wellhead housing that is at or near the seafloor. Running the high pressure wellhead and the MCD to the seafloor in a single run can reduce time and cost associated with typical multiple runs.

The devices and methods of the present application also include a hydraulically operated lockdown tool that exerts a pre-load stress on a conductor wellhead housing and a high pressure wellhead seated in the conductor wellhead housing. The lockdown tool can be used to actuate a lockdown mechanism (e.g., slips) that is between the high pressure wellhead and the conductor wellhead housing. Upon actuation of the lockdown mechanism by the lockdown tool, the lockdown tool may be removed. The lockdown mechanism maintains the desired stress state between the high pressure wellhead and the conductor wellhead housing connection. The lockdown tool assembly of the present application is positioned annularly around the high pressure wellhead and does not block the top of the high pressure wellhead, allowing other equipment, such as a MCD, to be run at or near the seafloor along with the high pressure wellhead, thus saving time and expense.

Illustrative embodiments of the invention are described below. In the interest of clarity, not all features of an actual implementation are described in this specification. One of ordinary skill in the art will appreciate that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present invention may be better understood by reading the following description of non-limitative embodiments with reference to the attached drawings wherein like parts of each of the figures are identified by the same reference characters. The words and phrases used herein should be understood and interpreted to have a meaning consistent with the understanding of those words and phrases by those skilled in the relevant art. No special definition of a term or phrase, for example, a definition that is different from the ordinary and customary meaning as understood by those skilled in the art, is intended to be implied by consistent usage of the term or phrase herein. To the extent that a term or phrase is intended to have a special meaning, for instance, a meaning other than that understood by skilled artisans, such a special definition will be expressly set forth in the specification in a definitional manner that directly and unequivocally provides the special definition for the term or phrase.

Turning to the drawings, FIG. 1 illustrates a system 100 that includes a running tool assembly 102 coupled to a high pressure wellhead 106 for running a mudline closure device (MCD) 104 and the high pressure wellhead 106 according to an example embodiment. As illustrated in FIG. 1, a casing 108 is coupled to the high pressure wellhead 106. For example, the casing may be an 18" inner diameter casing. The casing 108 may include multiple casings that are screwed or otherwise coupled to each other. The casing 108 may be coupled to the high pressure wellhead 106 by one of several means known to those of ordinary skill in the art. In certain exemplary embodiments, a wear sleeve or bushing 126 is attached to the high pressure wellhead 106 to protect the inner surface of the wellhead 106 from damage during drilling operations.

In some example embodiments, the MCD 104 may be coupled to the high pressure wellhead 106. For example, the MCD 104 may be coupled to the high pressure wellhead 106 at an upper end portion of the high pressure wellhead 106. To illustrate, the high pressure wellhead 106 may include a profile 122 on an outer surface. For example, the profile 122 of the high pressure wellhead 106 may be a proprietary profile specific to a manufacturer of the high pressure wellhead 106. Alternatively, the profile 122 may be a standard profile that is commonly used by different manufacturers. The profile 122 of the high pressure wellhead 106 is designed to mate with a profile 120 on an inner surface of the MCD 104. For example, a lower end portion of the MCD 104 may be positioned annularly around the upper end portion of the high pressure wellhead 106 such that the profile 120 of the MCD 104 and the profile 122 of the high pressure wellhead 106 interlock with each other. In some alternative embodiments, the MCD 104 may be coupled to the high pressure wellhead 106 by other means as may be contemplated by those of ordinary skill in the art with the benefit of this disclosure.

In some example embodiments, the running tool assembly 102 includes an upper pipe 110, a test plug release mechanism 130, an inner diameter isolation tool 132, a test plug 114, and a lower pipe 112. The upper pipe 110 and the test plug release mechanism 130 may be coupled to each other, and the test plug release mechanism 130 and the inner diameter isolation tool 132 may be coupled the each other. To illustrate, a bottom end portion of the upper pipe 110 and a top end portion of the test plug release mechanism 130 may be detachably coupled to each other, and a bottom end portion of the test plug release mechanism 130 and a top end portion of the inner diameter isolation tool 132 may be detachably coupled to each other. The inner diameter isolation tool 132 and the test plug 114 may be coupled to each other, and the test plug 114 and the lower pipe 112 may be coupled to each other. To illustrate, a bottom end portion of the inner diameter isolation tool 132 and a top end portion of the test plug 114 may be detachably coupled to each other, and a bottom end portion of the test plug 114 and a top end portion of the lower pipe 112 may be detachably coupled to each other. In certain exemplary embodiments, the lower pipe 112 includes multiple small pipe sections (not shown) to make up the overall lower pipe 112.

In alternate embodiments, the test plug 114 may be positioned between the test plug release mechanism 130 and the inner diameter isolation tool 132. To illustrate, the test plug release mechanism 130 may be detachably coupled to bottom end portion of the upper pipe 110 and the top end portion of the test plug 114, and the inner diameter isolation tool 132 may be detachably coupled to the bottom end portion of the test plug 114 and the top end portion of the lower pipe 112.

In certain exemplary embodiments, the test plug release mechanism 130 is detachably coupled to the running tool assembly 102. In some embodiments, the upper pipe 110 may be detached from the running tool assembly 102 using the test plug release mechanism 130. The test plug release mechanism 130 may be constructed as a J-slot using a small turn and straight pull to disengage, threads in which torque and rotation is applied to disengage, shear pins in which tension and/or rotation is applied to disengage, a ball catcher sub in which pressure is applied to disengage, or a simple seal and seal bore arrangement in which straight tension is used to disengage, among examples as one skilled in the art would understand.

In certain exemplary embodiments, the inner diameter isolation tool 132 may be constructed as a ball catcher sub, in which a properly sized ball matched to the catcher sub dropped inside a running string (not shown) would land and be caught in the ball catcher sub and provide a pressure seal at the inner diameter isolation tool 132 to allow pressure to be applied above the inner diameter isolation tool 132 and above the test plug 114 to pressure test the MCD 104. In other embodiments, a dart could be used in place of the ball and the dart would be pumped to land in its properly sized catcher sub to provide the pressure isolation. In yet other embodiments, a spring loaded flapper valve could be used as the inner diameter isolation tool 132 in which an inner tube holds the flapper valve open until the test plug release mechanism 130 is activated and disengages, thereby the inner tube is retrieved with a top portion of the test plug release mechanism 130, among examples as one skilled in the art would understand.

As illustrated in FIG. 1, the test plug 114 is coupled to the lower pipe 112. The test plug 114 is positioned in the high pressure wellhead 106 and extends toward the inner surface of the high pressure wellhead 106. To illustrate, the test plug 114 may include a profile 116 on its radially outermost surface facing the inner surface of the high pressure wellhead 106. The profile 116 of the test plug 114 is designed to mate the profile 118 of the high pressure wellhead 106 such that the test plug 114 is coupled to the high pressure wellhead 106 by the mating profiles 116, 118. In some alternative embodiments, the test plug 114 may be coupled to the high pressure wellhead 106 by other means as may be contemplated by those of ordinary skill in the art with the benefit of this disclosure. In certain exemplary embodiments, as shown in FIG. 1, the test plug 114 functions as a running tool and is a weight bearing mechanism for the casing 108, MCD 104, wellhead 106, etc. In alternate embodiments, the running tool can be a separate component from the test plug 114.

As understood by those of ordinary skill in the art, the MCD 104 allows for temporary disconnecting of the surface equipment (e.g., a rig) from a subsea well. For example, the surface equipment may be disconnected from the well by the MCD 104 for reasons such as bad weather conditions.

In general, the MCD 104 may have on board activation power and pressure testing capability to perform self-testing and/or accessibility to a remote operated vehicle (ROV) to perform such testing. As shown in FIG. 1, the test plug 114 is positioned generally below the MCD 104 to provide a pressure seal that allows the MCD 104 to perform pressure and functional testing. To illustrate, after running the MCD 104 to or near the seafloor, the MCD 104 performs self-testing to determine, for example, proper attachment to the high pressure wellhead 106. As described below in more detail, the MCD 104 performs self-testing after the upper pipe 110 of the running tool assembly 102 is disconnected from the lower pipe 112 of the test plug 114.

In some example embodiments, the test plug 114 may serve as a tension load support structure to support the downward load resulting from the upper pipe 110 and the lower pipe 112. In some alternative embodiments, the test plug 114 may just provide a pressure seal for the MCD 104 and another structure may be used to provide tension load support.

In some example embodiments, the running tool assembly 102 includes a launch tool 128 that includes one or more cement wiper plugs 124. The launch tool 128 can be coupled to the lower pipe 112. For example, the launch tool 128 may be coupled proximal to a bottom end portion of the lower pipe 112. After the system 100 of FIG. 1 is run to or near a seafloor such that the high pressure wellhead 106 is seated in a conductor wellhead housing, such as the conductor wellhead housing 302 shown in FIG. 3, cementing of the casing 108 may be performed as understood by those of ordinary skill in the art with the benefit of this disclosure. During cementing, the cement wiper plugs 124 are detached from the launch tool 128. For example, balls or darts can detach a cement wiper plug 124 ahead of the cement that is pumped down, and balls or darts can also detach another one of the cement wiper plugs 124 following the cement.

Figure 3:
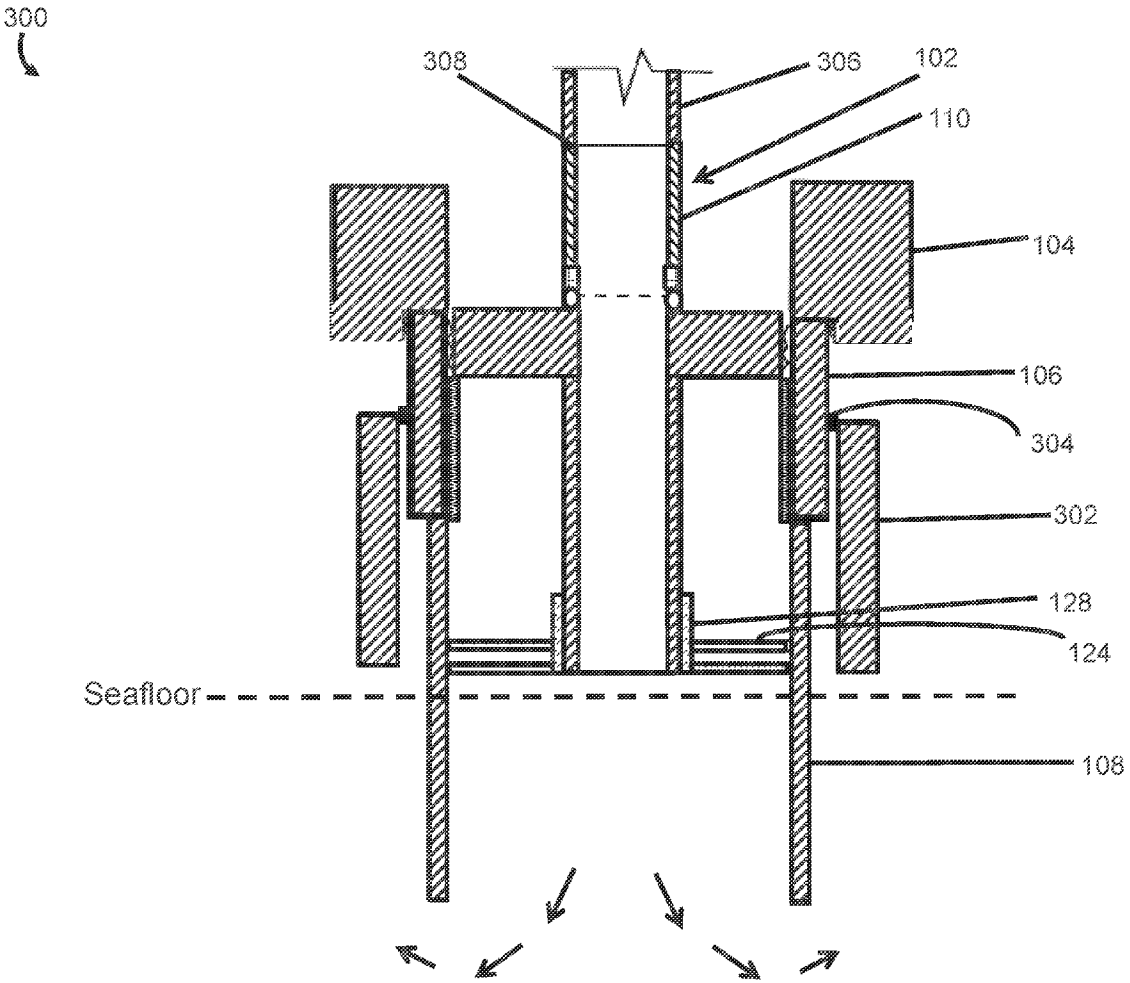
FIG. 3 illustrates a cross-sectional view of the running tool assembly of FIG. 1 attached to a running string according to an example embodiment.

The running tool assembly 102 may be constructed generally from steel and/or other suitable material as may be contemplated by those of ordinary skill in the art with the benefit of this disclosure. The test plug 114 may be constructed from a single structure or may be formed into an annular shape from two or more segments. As illustrated in FIG. 1, the running tool assembly 102 may be coupled to the high pressure wellhead 106 by virtue of the mating profiles 116, 118. The casing 108 is coupled to the high pressure wellhead 106 as described above. The MCD 104 may be coupled to the high pressure wellhead 106 by virtue of the mating profiles 120, 122 or other similar means without departing from the scope of this disclosure. The MCD 104, the high pressure wellhead 106 and the casing 108 may be run to or near a seafloor by the running tool assembly 102 and positioned such that the high pressure wellhead 106 is seated in conductor wellhead housing as illustrated in FIG. 3. By running the MCD 104 and the high pressure wellhead 106 in a single trip, time and associated expense may be reduced. Further, because the MCD 104 is not closed off on its top side, the test plug 114 may be removed after testing of the MCD 104 is completed without a retrieving tool (not shown) to pull up the test plug 114, whereby the retrieving tool is run on pipe from the surface equipment (rig). For example, a remote operated vehicle may be coupled to the appropriate handle to remove the test plug 114.

Figure 2:
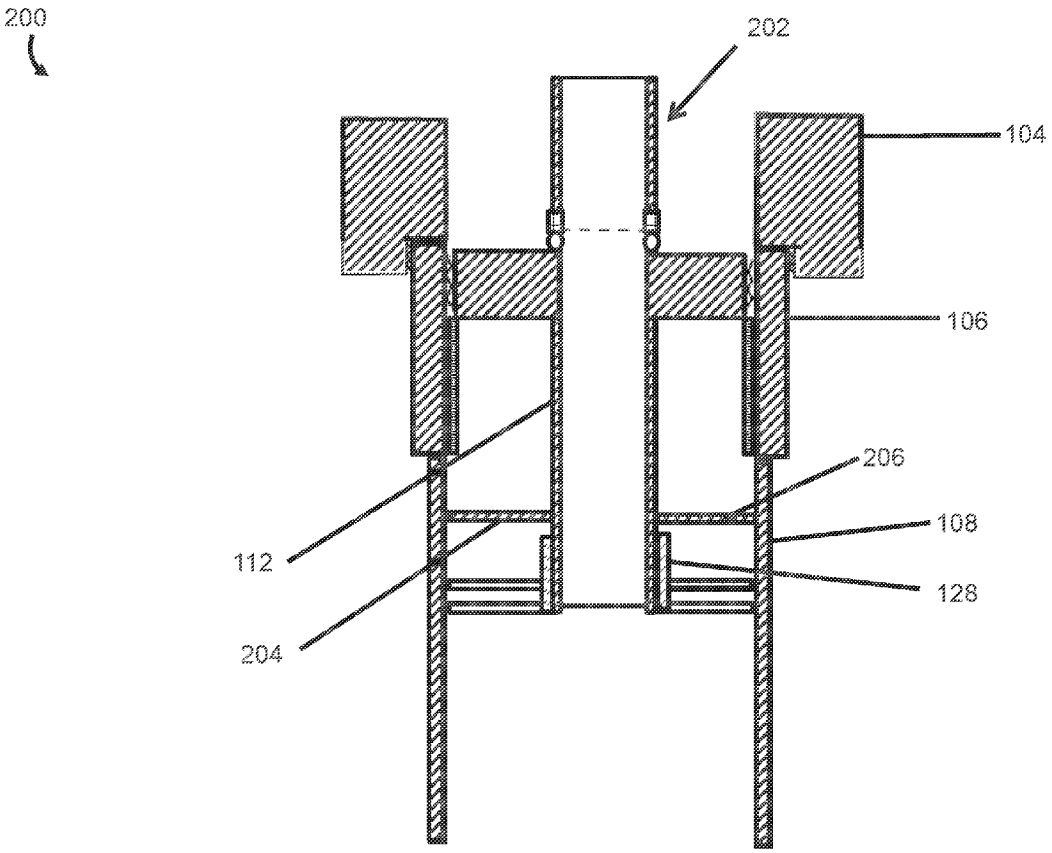
FIG. 2 illustrates a cross-sectional view of a running tool assembly attached to a high pressure wellhead for running an MCD and the high pressure wellhead according to another example embodiment.

FIG. 2 illustrates a cross-sectional view of a system 200 that includes a running tool assembly 202 coupled to the high pressure wellhead 106 for running the MCD 104 and the high pressure wellhead 106, according to another example embodiment. The running tool assembly 202 is substantially the same as the running tool assembly 102 of FIG. 1, except as specifically stated below. For the sake of brevity, the similarities will not be repeated hereinbelow. Referring now to FIG. 2, in some example embodiments, the lower pipe 112 may include an environmental seal 204. The seal 204 may be positioned above the launch tool 128. The seal 204 may include a port 206 for pressure equalization above and below the seal 204. The seal 204 extends outwardly from the lower pipe 112 toward the inner surface of the casing 108 and is designed to prevent cement from moving upwards between the lower pipe 112 and the wellhead 106. Alternatively, the seal 204 could be positioned towards the base of the high pressure wellhead 106. The running tool assembly 202 may be used in the same manner as described with respect to the running tool assembly 102.

FIG. 3 illustrates a cross-sectional view of a system 300 that includes the running tool assembly 102 of FIG. 1 coupled to a running string 306, according to an example embodiment. The system 300 is substantially the same as that described above with regard to the system 100 of FIG. 1, except as specifically stated below. For the sake of brevity, the similarities will not be repeated hereinbelow. Referring now to FIG. 3, the running string 306 is coupled to the running tool assembly 102. To illustrate, the running string 306 is coupled to the upper pipe 110 at a joint 308. For example, the running string 306 may be screwed on to the upper end portion of the upper pipe 110.

To illustrate, after a desired length of the casing 108 is assembled by screwing together multiple casings, the casing 108 is coupled to the high pressure wellhead 106 at the surface (e.g., offshore rig) as described above or at a factory. The MCD 104 may then be coupled to the high pressure wellhead 106. The running tool assembly 102 components may then be coupled together to form the running tool assembly at the surface or factory. The running tool assembly 102 may then be coupled to the high pressure wellhead 106.

Before running the MCD 104, the high pressure wellhead 106, and the casing 108 to or near the seafloor level using the running tool assembly 102, the running string 306 is coupled to the upper pipe 110. The running tool assembly 102 coupled to the running string 306 may then be used to run the MCD 104, the high pressure wellhead 106, and the casing 108 to or near the seafloor in a single trip, where the high pressure wellhead 106 is seated in a conductor wellhead housing 302.

As illustrated in FIG. 3, a lockdown mechanism 304 may be positioned between the conductor wellhead housing 302 and the high pressure wellhead 106. Once actuated, for example, by a lockdown tool, the lockdown mechanism 304 holds the conductor wellhead housing 302 and the high pressure wellhead 106 together. For example, the lockdown mechanism 304 may include slips or other similar means as understood by those of ordinary skill in the art with the benefit of this disclosure. The lockdown mechanism 304 may be actuated prior to start of production.

After running the MCD 104, the high pressure wellhead 106, and the casing 108 to or near the seafloor level using the running tool assembly 102 such that the high pressure wellhead 106 is seated in the conductor wellhead housing 302, cementing of the casing 108 may be performed by pumping down cement through the running string 306 and the running tool assembly 102 such that the cement moves in the direction of the arrows at the bottom of the casing 108. Darts or balls (not shown) may be used to launch the cement wiper plugs 124 from the launch tool 128 in performing the cementing operation. After the pumping down of cement through the running string 306, the running tool assembly 102, and casing 108 is completed, testing of the MCD 104 may be started immediately after the cement pumping is completed and the upper pipe 110 is released from the test plug 114. Because testing of the MCD 104 may be performed immediately after completion of cementing operations, significant time may be saved as compared to the typical process where the testing of the MCD 104 is performed after the running string 306 is recovered back to the surface equipment (rig) and an MCD is then run on the drilling riser or a cable.

Figure 4:
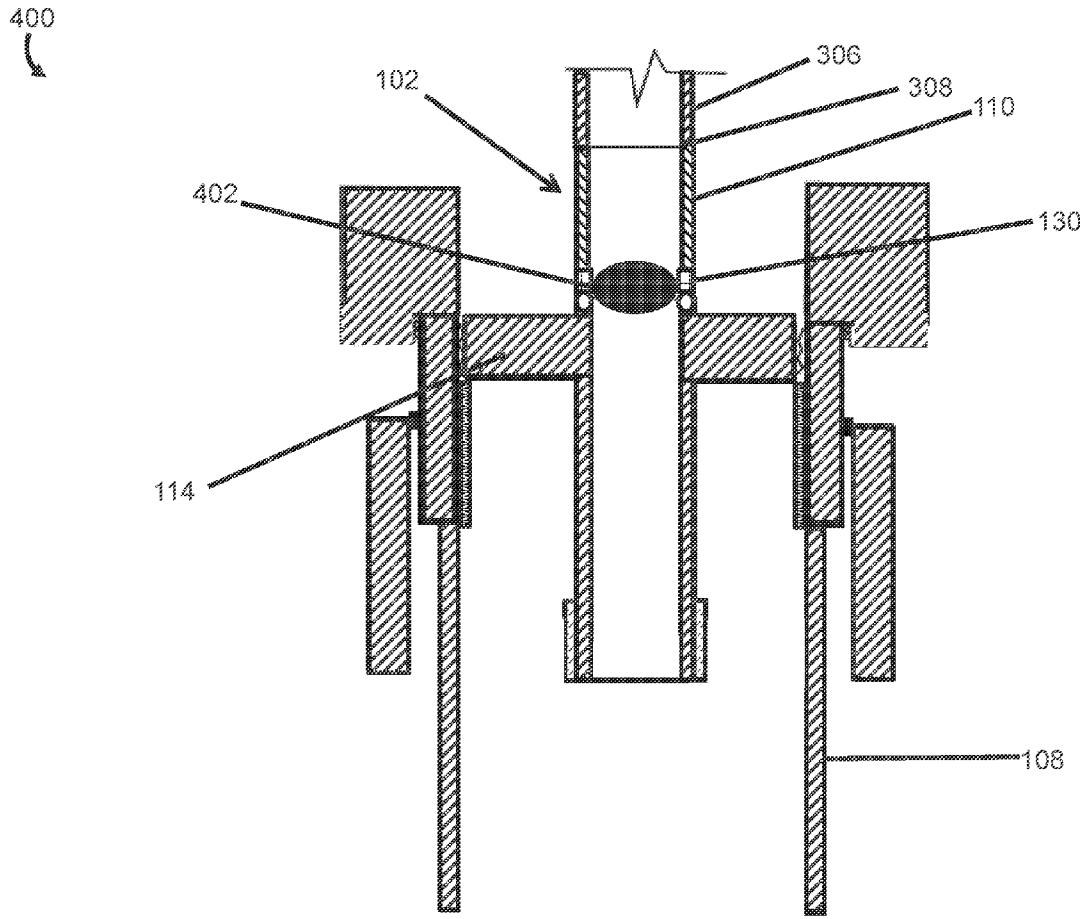
FIG. 4 illustrates a ball dropped in the running tool assembly of FIG. 1 according to an example embodiment.

FIG. 4 illustrates a system 400 wherein a ball 402 is dropped in the running tool assembly 102 shown in the system 300 of FIG. 3, according to an example embodiment. After cementing of the casing 108 is performed, the ball 402 may be dropped, for example, from a rig to close off the opening at the test plug release mechanism 130. The ball 402 is dropped through the running string 306 that is connected to the upper pipe 110 at the joint 308. The ball 402 may stop at the upper opening of the test plug release mechanism 130 because, for example, the upper opening of the test plug release mechanism 130 is smaller than the ball 402. After the ball 402 is placed on a seat/profile of the upper opening of the test plug release mechanism 130, the upper pipe 110 may be detached from the test plug release mechanism 130 by applying pressure, such hydraulic pressure, that shears off shear pins that may be used to attach the upper pipe 110 to the test plug release mechanism 130. Alternatively, rotation force may be used to shear off the pins. Other means may be used to detach the upper pipe 110 from the test plug release mechanism 130 based on the means of attachment used in attaching the upper pipe 110 to the test plug release mechanism 130. In certain alternate embodiments where the test plug 114 is positioned between the test plug release mechanism 130 and the inner diameter isolation tool 132, the ball 402 may stop at a position below the test plug 114 at the inner diameter isolation tool 132.

Figure 5:
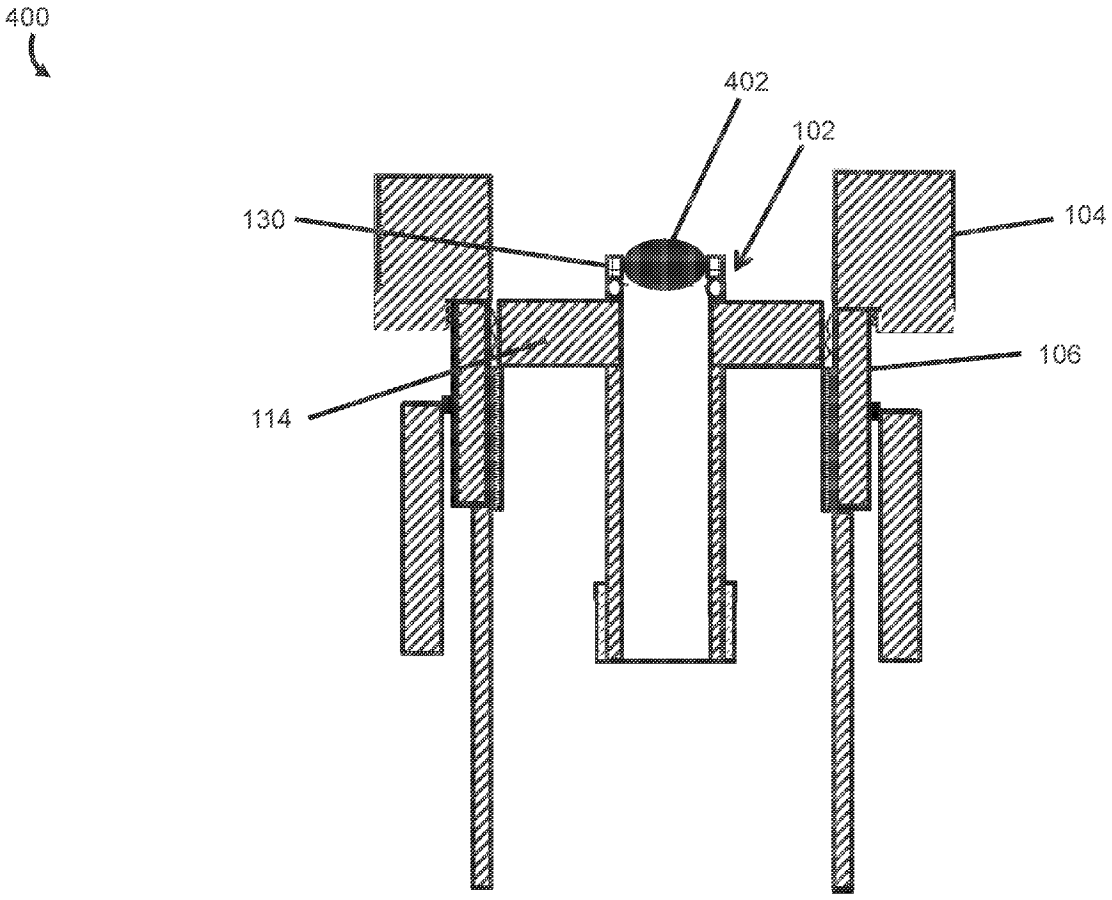
FIG. 5 illustrates the running tool assembly of FIG. 4 without an upper segment of the running tool assembly after disconnection from a lower segment according to an example embodiment.

FIG. 5 illustrates the system 400 of FIG. 4 that includes the running tool assembly 102 disconnected from the upper pipe 110 (not shown), according to an example embodiment. Referring to FIG. 5, the ball 402 is positioned in a seat of the test plug release mechanism 130 at an upper opening of the test plug release mechanism 130 and closing off the upper opening. The test plug 114 of the running tool assembly 102 remains coupled to the high pressure wellhead 106. The MCD 104 is positioned on the high pressure wellhead 106. Because the upper pipe 110 shown in FIG. 4 is detached and removed, for example, by the running string 306, the MCD 104 can start performing testing such as pressure testing. The ball 402 and the test plug 114 provide a pressure seal on the bottom side of the MCD 104 to enable the testing of the MCD 104. The testing of the MCD 104 may be performed while pulling the running string 306 of FIG. 3 back to surface, as described above. The overlapping of the testing of the MCD 104 and the pulling the running string 306 back to surface may result in significant time and cost savings as compared to a serial operation of the steps.

Figure 6:
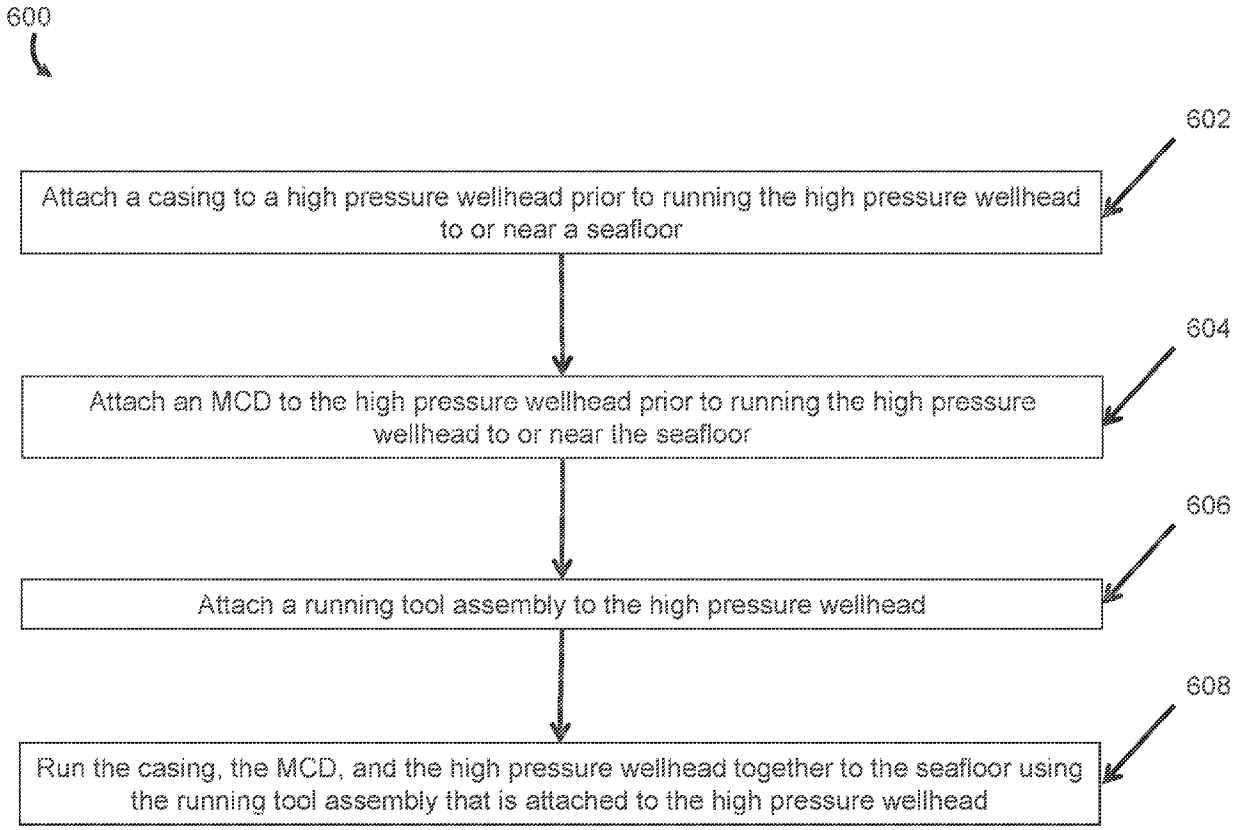
FIG. 6 illustrates a flowchart of a method of running a high pressure wellhead and an MCD in a single trip using a running tool assembly such as the running tool assembly of FIG. 1 according to an example embodiment.
Figure 8:
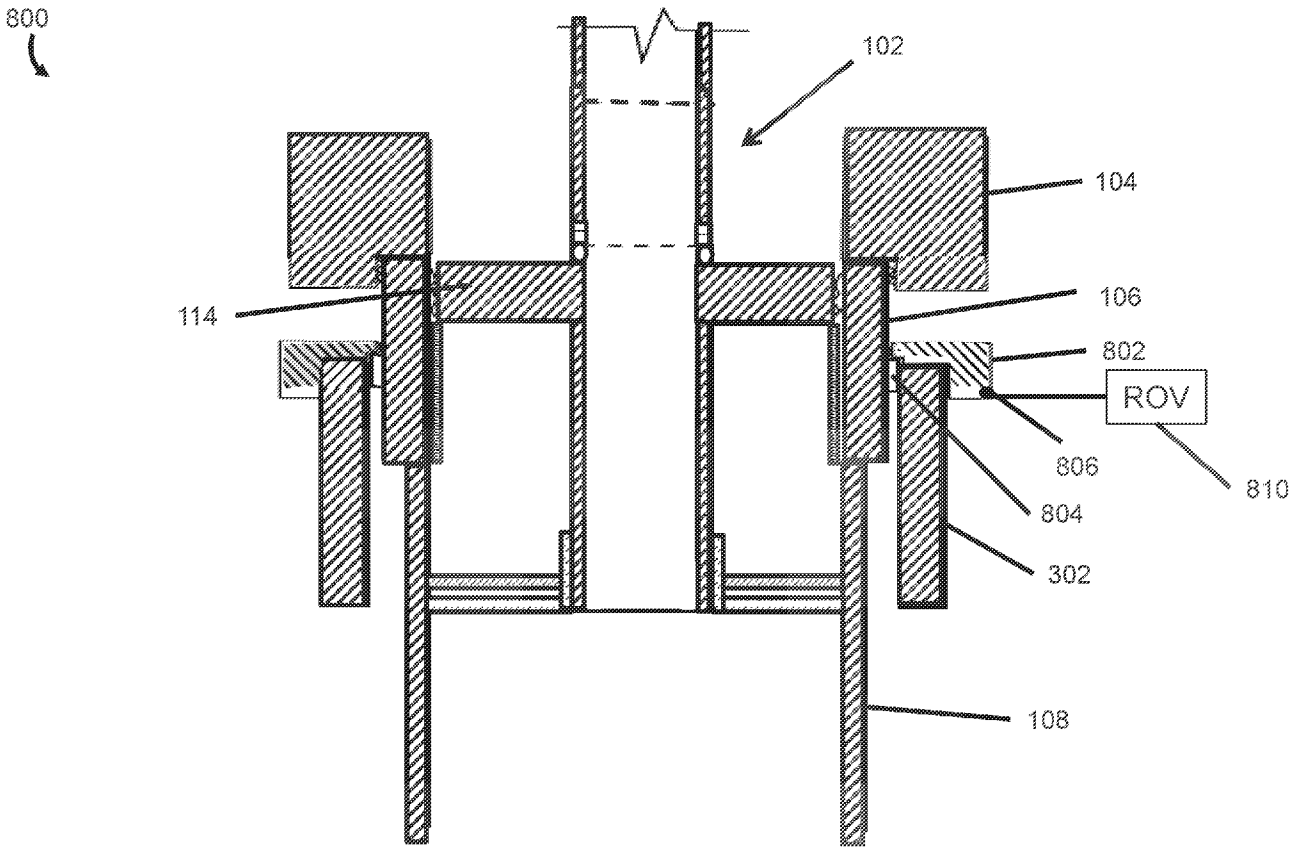
FIG. 8 illustrates a cross-sectional view of a lockdown tool attached to a high pressure wellhead, a locking mechanism, and an MCD according to an example embodiment.

FIG. 6 illustrates a flowchart of a method of running a high pressure wellhead and an MCD in a single trip using a running tool assembly, such as the running tool assembly 102 of FIG. 1, according to an example embodiment. Referring to FIGS. 1 and 8, at step 602, the method 600 includes attaching a casing to a high pressure wellhead prior to running the high pressure wellhead to or near a seafloor. For example, the casing 108 may be coupled to the high pressure wellhead 106 at the surface (e.g., a rig) or at a factory prior to running the high pressure wellhead 106 to or near a seafloor. At step 604, the method 600 includes attaching an MCD to the high pressure wellhead prior to running the high pressure wellhead to or near the seafloor. For example, the MCD 104 may be coupled to the top of the high pressure wellhead 106 as described above. At step 606, the method 600 includes attaching a running tool assembly to the high pressure wellhead. For example, the running tool assembly 102 may be coupled to the high pressure wellhead 106.

At step 608, the method 600 includes running the casing, the MCD, and the high pressure wellhead together to or near the seafloor using the running tool assembly that is coupled to the high pressure wellhead. To illustrate, the casing 108, the MCD 104, and the high pressure wellhead 106 that are coupled, as described above, may be run to or near the seafloor. As described above, the running tool assembly 102 may be coupled to the high pressure wellhead 106 through the MCD 104. When the high pressure wellhead 106 is run to or near the seafloor, the high pressure wellhead 106 is positioned in a conductor wellhead housing positioned at or near the seafloor. The method 600 may also include attaching a running string such as the running string shown FIG. 3 to the running tool assembly 102 to prior to running the casing 108, the MCD 104, and the high pressure wellhead 106 to or near the seafloor.

In some example embodiments, after the casing 108, the MCD 104, and the high pressure wellhead 106 are run to or near the seafloor, testing of the MCD 104 may be performed as described above. Prior to testing of the MCD 104, cementing of the casing 108 is performed through the upper pipe 110 and lower pipe 112 of the running tool assembly 102. After cementing is performed and prior to testing the MCD 104, a ball or a dart may be dropped (e.g., from the rig) to the running tool assembly 102 through the running string 306, wherein the ball and the dart are sized to sit in and block an opening of the lower pipe 112 of the running tool assembly 102. After the ball or dart is positioned on the opening of the lower pipe 112 and prior to testing the MCD 104, the upper pipe 110 of the running tool assembly 102 is disconnected from the lower pipe 112 as described above.

Figure 7:
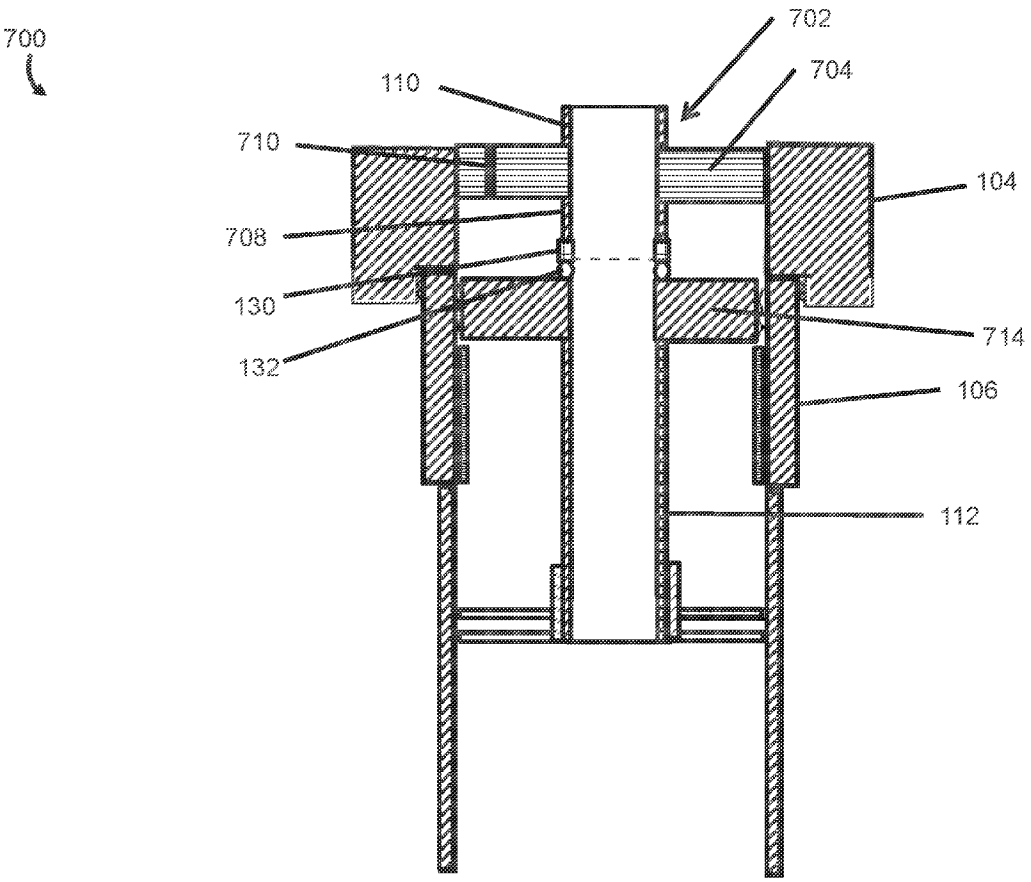
FIG. 7 illustrates a cross-sectional view of a running tool assembly attached to a high pressure wellhead and to an MCD for running the MCD and the high pressure wellhead according to an example embodiment.

FIG. 7 illustrates a cross-sectional view of a system 700 having a running tool assembly 702 coupled to a MCD 104 for running the MCD 104 and the high pressure wellhead 106 according to an example embodiment. The running tool assembly 702 is substantially the same as that described above with regard to running tool assembly 102, except as specifically stated below. For the sake of brevity, the similarities will not be repeated hereinbelow. Referring now to FIG. 7, the running tool assembly 702 may include the upper pipe 110, a running tool or tension load support structure 704, a middle pipe 708, the test plug release mechanism 130, the inner diameter isolation tool 132, a test plug 714, and the lower pipe 112.

The upper pipe 110 and the tension load support structure 704 may be coupled to each other, and the tension load support structure 704 and the middle pipe 708 may be coupled the each other. To illustrate, a bottom end portion of the upper pipe 110 and a top end portion of the tension load support structure 704 may be detachably coupled to each other, and a bottom end portion of the tension load support structure 704 and a top end portion of the middle pipe 708 may be detachably coupled to each other. The middle pipe 708 and the test plug release mechanism 130 may be coupled to each other. To illustrate, a bottom end portion of the middle pipe 708 and a top end portion of the test plug release mechanism 130 may be detachably coupled to each other. The inner diameter isolation tool 132 may be coupled to the test plug release mechanism 130 and the test plug 714 similar to how the inner diameter isolation tool 132 is coupled to the test plug release mechanism 130 and the test plug 114.

In exemplary embodiments, the tension load support structure 704 supports the downward load resulting from, for example, the sections of the running tool assembly 702 below the upper pipe 110. In certain embodiments, the tension load support structure 704 includes a port 710 for pressure equalization above and below the tension load support structure 704. In some example embodiments, the test plug 714 provides a pressure seal at a top of the high pressure wellhead 106. In the example embodiment of FIG. 7, the test plug 714 may serve to provide a pressure seal for the MCD 104 testing without functioning as a tension load support structure to support the upper pipe 110, the middle pipe 708, the lower pipe 112, and any other downward load. In some example embodiments, the tension load support structure 704 may be coupled to the MCD 104 in a similar manner as the test plug 114 is coupled to the wellhead 106 in FIG. 1 except that the tension load support structure 704 may be coupled to the MCD 104 proximal to an upper end of the MCD 104.

FIG. 8 illustrates a cross-sectional view of a system 800 that includes a lockdown tool 802 coupled to the high pressure wellhead 106, to a lockdown mechanism 804, and to the MCD 104 according to an example embodiment. As illustrated in FIG. 8, the casing 108 is coupled to the high pressure wellhead 106 as described above. The lockdown tool 802 may be coupled to the high pressure wellhead 106 by means of matching profiles or using slips as can be understood by those of ordinary skill in the art with the benefit of this disclosure. The lockdown tool 802 is annularly positioned around the high pressure wellhead 106.

In some example embodiments, the lockdown mechanism 804 is run to or near the seafloor using the running tool assembly 102 after attachment of the lockdown mechanism 804 to the high pressure wellhead 106 at the surface or at a factory. The lockdown tool 802 may also be run along with the high pressure wellhead 106 using the running tool assembly 102. For example, the lockdown tool 802 may be coupled to the high pressure wellhead 106 at the surface or at a factory. The lockdown tool 802 may be positioned on the conductor wellhead housing 302 when the high pressure wellhead 106 is run to or near the seafloor and seated in the conductor wellhead housing 302.

The lockdown tool 802 may include a hydraulic pressure port 806 to attach to a hydraulic pressure source. For example, a remote operated vehicle (ROV) 810 may be used to apply hydraulic pressure to the inside of the lockdown tool 802 via the hydraulic pressure port 806. For example, when hydraulic pressure is applied to the lockdown tool 802, a compressive stress is applied on the conductor wellhead housing 302 and a tensile stress is applied on the high pressure wellhead 106 to create a pre-loaded stress on the conductor wellhead housing 302 and the high pressure wellhead 106. As a result of the stress applied the lockdown tool 802, the lockdown mechanism 804 is actuated, thereby retaining the high pressure wellhead 106 and conductor wellhead housing 302 coupled to each other. For example, the lockdown mechanism 804 may include slips and/or other means to keep the high pressure wellhead 106 and the conductor wellhead housing 302 together.

After the lockdown mechanism 804 is actuated, the lockdown tool 802 may be left in place or it may be removed from the high pressure wellhead 106. For example, the lockdown tool 802 may be made from multiple segments and each segment may be removed, for example, by an arm coupled to ROV 810. To illustrate, the lockdown tool 802 may be made by attaching two half segments that together fit annularly around the high pressure wellhead 106. The two half segments may then be detached from each other to remove the lockdown tool 802. Alternatively, the lockdown tool 802 may be made from more than two segments that for an annular shape and that may be detached from each other to remove the lockdown tool 802 from the high pressure wellhead 106.

Because the lockdown tool 802 does not cover the top opening of the MCD 104, an ROV 810 and means other than a running tool may be used to remove components, such as test plug 114 after testing of the MCD 104 is completed. The ability to use an ROV as compared to a running tool may reduce time can cost associated with removing and recovering components such as the test plug 114.

Figure 9:
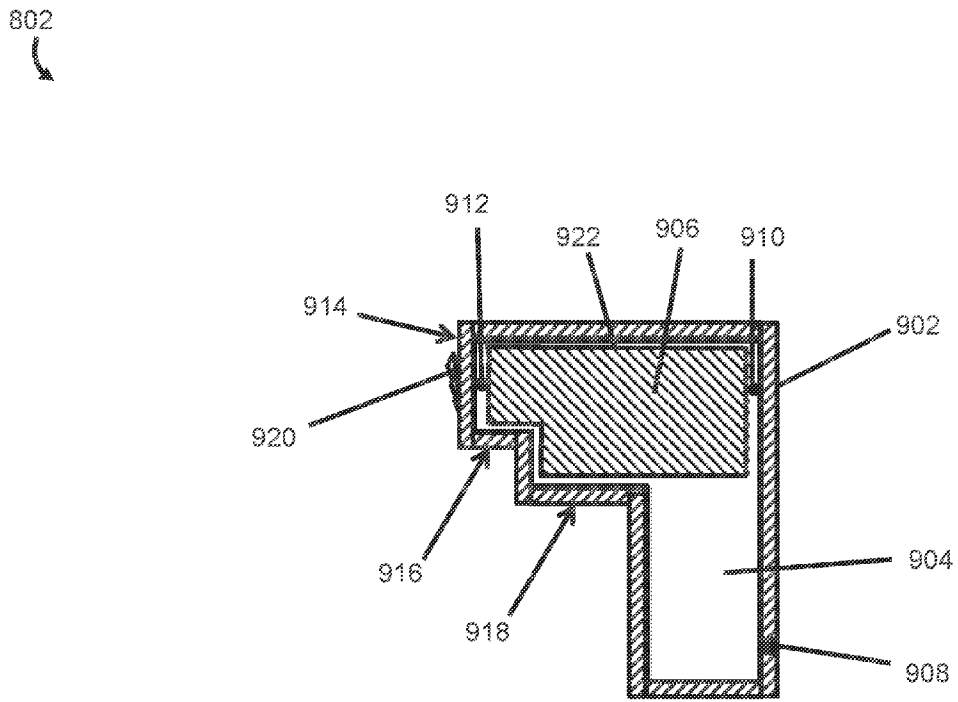
FIG. 9 illustrates a cross-sectional view of the lockdown tool of FIG. 8 for actuating a lockdown mechanism between a high pressure wellhead and a conductor wellhead housing according to an example embodiment.

FIG. 9 illustrates a cross-sectional view of the lockdown tool 802 of FIG. 8 for actuating a lockdown mechanism between the high pressure wellhead 106 and the conductor wellhead housing 302 according to an example embodiment. Referring to FIGS. 8 and 9, the lockdown tool 802 may include a housing 902 and piston 906 positioned in a cavity 904 of the housing 902. The lockdown tool 802 includes a hydraulic pressure port 908 that has a profile for receiving a connector from a hydraulic pressure source, such as the ROV 810 or operated by the ROV 810. The hydraulic pressure port 908 provides a controlled passageway into the cavity 904 of the housing 902 for applying a hydraulic pressure into the cavity 904 from outside the lockdown tool 802. For example, the cavity 904 may be fully enclosed by the housing with the hydraulic pressure port 908 providing a controlled passageway. The hydraulic pressure port 908 may be positioned below the piston 906 or may be position a different location with a conduit to the area below the piston 906. The hydraulic pressure port 908 functions in a same manner as the hydraulic pressure port 806 of FIG. 8.

In some example embodiments, the housing 902 includes a wellhead facing surface 914, a lockdown mechanism facing surface 916, and a conductor wellhead housing facing surface 918. The conductor wellhead housing facing surface 918 is designed to come in contact with the conductor wellhead housing 302. The lockdown mechanism facing surface 916 is designed to come in contact with the lockdown mechanism 804 that is at least partially positioned between the conductor wellhead housing 302 and the high pressure wellhead 106 seated in the conductor wellhead housing 302. The wellhead facing surface 914 may have a profile 920 that matches a profile of the high pressure wellhead 106 formed an outer surface of the high pressure wellhead 106 to attach the lockdown tool 802 to the high pressure wellhead 106. In some alternative embodiments, a slip arrangement may be used instead of matching profiles to attach the lockdown tool 802 to the high pressure wellhead 106.

In some example embodiments, the lockdown tool 802 includes a seal 910 positioned between the piston 906 and a wall of the housing 902 on one side of the housing 902. Another seal 912 may be positioned between the piston 906 and a wall on opposite side of the housing 902. The seals 910, 912 are positioned to prevent hydraulic fluid introduced into the cavity 902 of the lockdown tool 802 from reaching a space 922 above piston 906.

In some example embodiments, the cavity 904 may be filled with air or another gas at the surface or in a factory before the lockdown tool 802 is run to or near the seafloor. The ROV 810 or another equipment may be used to apply hydraulic pressure to the cavity 904 of the housing 902. The applied hydraulic pressure may result in a compressive stress on the conductor wellhead housing 302 because of the downward force exerted on a segment of the housing 902 that includes the conductor wellhead housing facing surface 918. A tensile stress may be exerted by the lockdown tool 802 on the high pressure wellhead 106 because of the upward force resulting from the lifting of the piston 906 due to the hydraulic pressure.

In some example embodiments, the housing 902 may include a first half housing segment and a second half housing segment that are coupled to each other to form annular shape of the housing 902/the lockdown tool 802. In some alternative embodiments, the housing 902 may include three or more housing segments that are coupled together to form an annular shape of the housing 902/the lockdown tool 802. The housing 902 and the piston 906 may be made from steel or another suitable material as may be contemplated by those of ordinary skill in the art with the benefit of this disclosure. For example, the housing 902 and the piston 906 may be made by one or more methods such as machining, welding, etc.

Although a particular shape of the lockdown tool 802 is shown in FIG. 9, the lockdown tool 802 may have other shapes without departing from the scope of this disclosure. In general, the lockdown tool 802 may have surfaces and sides that match shapes and profiles of particular high pressure wellheads, conductor wellhead housings, and the lockdown mechanisms without departing from the scope of this disclosure.

Figure 10:
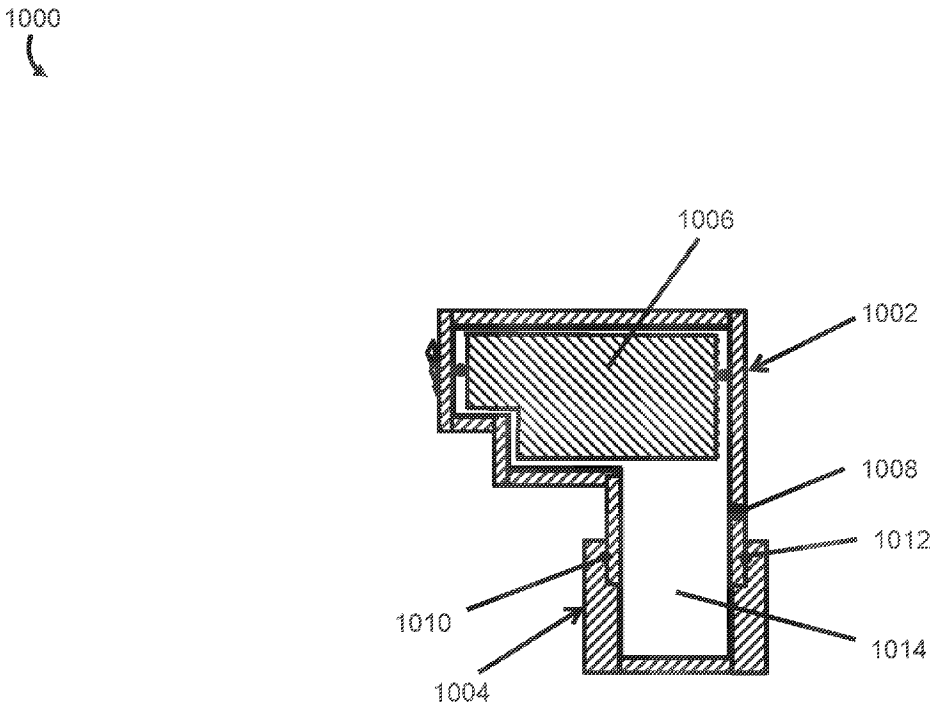
FIG. 10 illustrates a cross-sectional view of a lockdown tool for actuating a lockdown mechanism between a high pressure wellhead and a conductor wellhead housing according to another example embodiment.

FIG. 10 illustrates a cross-sectional view of a lockdown tool 1000 for actuating a lockdown mechanism between a high pressure wellhead and a conductor wellhead housing according to another example embodiment. For example, the lockdown tool 1000 may be used for actuating the lockdown mechanism 804 of FIG. 8 that is between the high pressure wellhead 106 and the conductor wellhead housing 302. The lockdown tool 1000 operates in a substantially the same manner as the lockdown tool 802 of FIGS. 8 and 9. As illustrated in FIG. 10, the lockdown tool 1000 may include an upper housing segment 1002 and a lower housing segment 1004. For example, the lower housing segment 1004 may be positioned on the outside of a portion of the upper housing segment 1002. Seals 1010, 1012 may be positioned between respective walls of the upper housing segment 1002 and the lower housing segment 1004 to retain the hydraulic fluid within a cavity 1014 of the lockdown tool 1000.

As illustrated in FIG. 10, a hydraulic pressure port 1008 may be positioned on the upper housing segment 1002 below a piston 1006 of the lockdown tool 1000. Alternatively, the hydraulic pressure port 1008 may be positioned on the lower housing segment 1004. The hydraulic pressure port 1008 functions in a same manner as the hydraulic pressure port 908 of FIG. 9.

Figure 11:
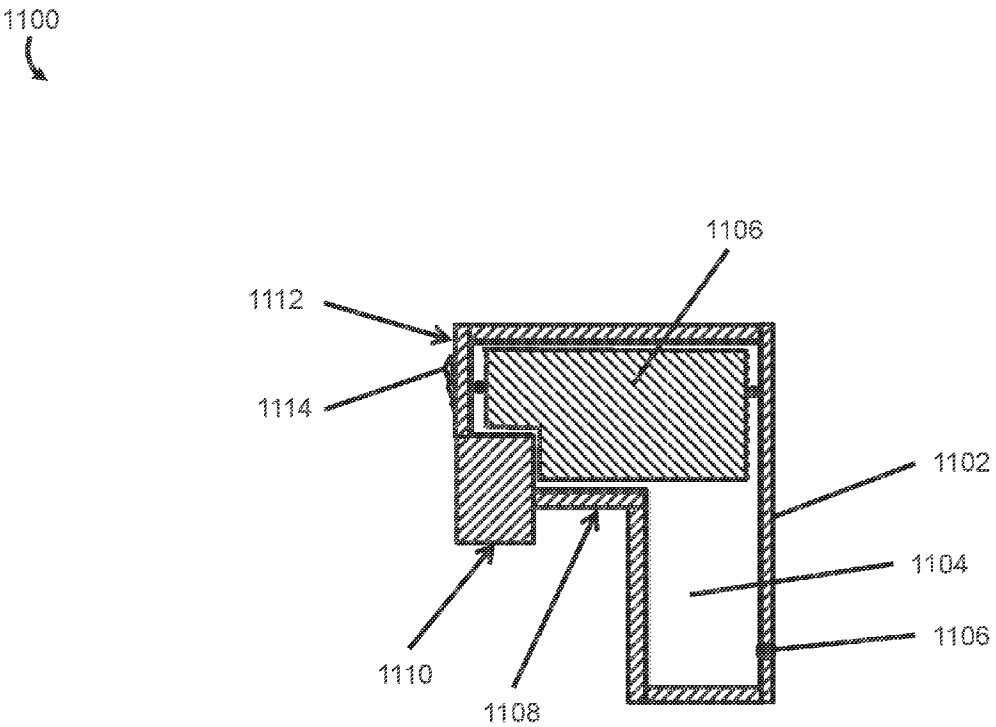
FIG. 11 illustrates a cross-sectional view of a lockdown tool for actuating a lockdown mechanism between a high pressure wellhead and a conductor wellhead housing according to another example embodiment.

FIG. 11 illustrates a cross-sectional view of a lockdown tool 1100 for actuating a lockdown mechanism that is between a high pressure wellhead and a conductor wellhead housing according to another example embodiment. The lockdown tool 1100 operates in a substantially the same manner as the lockdown tool 802 of FIGS. 8 and 9. In contrast to the lockdown tool 802, the lockdown tool 1100 may include a lockdown mechanism facing surface 1110 that is below a conductor wellhead housing facing surface 1108. For example, the lockdown tool 1100 may be used in systems where the top edge of the lockdown mechanism is below the top edge of the conductor wellhead housing.

As illustrated in FIG. 11, the lockdown tool 1100 includes a housing 1102 and a piston 1106 that is in a cavity 1104 of the housing 1102. A hydraulic pressure port 1106 operates and may be positioned as described with respect to the hydraulic pressure port 908 of FIG. 9. A profile 1114 for attaching to a high pressure wellhead, such as the high pressure wellhead 106, may be formed on a wellhead facing surface 1112 of the housing 1102.

Although some embodiments have been described herein in detail, the descriptions are by way of example. The features of the embodiments described herein are representative and, in alternative embodiments, certain features, elements, and/or steps may be added or omitted. Additionally, modifications to aspects of the embodiments described herein may be made by those skilled in the art without departing from the spirit and scope of the following claims, the scope of which are to be accorded the broadest interpretation so as to encompass modifications and equivalent structures. One of ordinary skill in the art will appreciate that in the development of any such actual embodiment, numerous implementation-specific decisions must be made to achieve the developers' specific goals, such as compliance with system-related constraints, which will vary from one implementation to another. Moreover, it will be appreciated that such a development effort might be complex and time-consuming, but would nevertheless be a routine undertaking for those of ordinary skill in the art having the benefit of this disclosure.

What is claimed is:

1. A lockdown tool for locking down a high pressure wellhead with a conductor wellhead housing, the lockdown tool comprising:

a housing comprising:

a first wall having a conductor wellhead housing facing surface designed to come in contact with the conductor wellhead housing positioned at or near a seafloor;

a second wall having a lockdown mechanism facing surface designed to come in contact with a lockdown mechanism that is at least partially positioned between the conductor wellhead housing and a high pressure wellhead seated in the conductor wellhead housing; and a third wall having a wellhead facing surface that includes a profile that matches a profile of the high pressure wellhead formed on an outer surface of the high pressure wellhead;

a piston positioned in a cavity of the housing, wherein the cavity is at least partially bound by the first wall, the second wall, and the third wall; and a hydraulic pressure port extending through a wall of the housing for applying hydraulic pressure by an external hydraulic pressure source into the cavity of the housing.

2. The lockdown tool of claim 1, further comprising a first seal positioned between the piston and the third wall of the housing, and a second seal positioned between the piston and a fourth wall of the housing, wherein the first seal and the second seal are positioned to prevent hydraulic fluid from reaching a space above the piston.

3. The lockdown tool of claim 1, further comprising a profile on the wellhead facing surface of the housing, wherein the profile on the wellhead facing surface of the housing matches a profile on an external surface of the high pressure wellhead to exert an upward force on the high pressure wellhead.

4. The lockdown tool of claim 1, wherein the housing is designed to be positioned annularly around the high pressure wellhead.

5. The lockdown tool of claim 1, wherein the housing comprises an upper housing segment and a lower housing segment.

6. The lockdown tool of claim 5, further comprising seals positioned between the lower housing segment and the upper housing segment.

7. The lockdown tool of claim 1, wherein the housing comprises a first half housing segment and a second half housing segment that are attached to each other to form an annular shape.

8. The lockdown tool of claim 1, wherein the hydraulic pressure port is positioned below the piston.

9. The lockdown tool of claim 1, wherein the lockdown mechanism facing surface is below the conductor wellhead housing facing surface.

10. The lockdown tool of claim 1, wherein the cavity is filled with air prior to applying hydraulic pressure to the cavity.

11. A method of actuating a lockdown mechanism positioned between a high pressure wellhead and a conductor wellhead housing, the method comprising:

attaching a lockdown tool to the high pressure wellhead, wherein the lockdown tool is annularly positioned around the high pressure wellhead;

running the high pressure wellhead to a seafloor along with the lockdown tool;

positioning the high pressure wellhead in the conductor wellhead housing positioned at the seafloor; and applying hydraulic pressure to a cavity of a housing of the lockdown tool, wherein the housing of the lockdown tool comprises a first wall having a conductor wellhead housing facing surface, a second wall having a lockdown mechanism facing surface, and a third wall having a wellhead facing surface that includes a profile that matches a profile of the high pressure wellhead, wherein a piston responsive to the hydraulic pressure is positioned within the cavity of the housing of the lockdown tool, and wherein the cavity is at least partially bound by the first wall, the second wall, and the third wall.

12. The method of claim 11, wherein applying hydraulic pressure comprises using a remote operated vehicle to connect a hydraulic pressure source to a hydraulic pressure port of the lockdown tool.

13. The method of claim 11, wherein positioning the high pressure wellhead in the conductor wellhead housing positioned at the seafloor positions the lockdown tool on the conductor wellhead housing.

14. The method of claim 11, wherein applying hydraulic pressure causes a downward stress on the conductor wellhead housing and a tensile stress on the high pressure wellhead.

15. The method of claim 11, further comprising removing the lockdown tool after actuating the lockdown mechanism.

16. The method of claim 15, wherein removing the lockdown tool comprises using a remote operated vehicle to remove the lockdown tool.

17. The method of claim 16, wherein using the remote operated vehicle to remove the lockdown tool comprises removing segments of the lockdown tool from the high pressure wellhead individually.

18. An offshore running and preloading system, comprising:

a running tool assembly for running a high pressure wellhead and a mudline closure device (MCD) to or near a seafloor, the running tool assembly comprising:

an upper pipe;

a test plug release mechanism detachably coupled in the running tool assembly;

an inner diameter isolation tool;

a test plug designed to be attached to a high pressure wellhead; and a lower pipe; and a lockdown tool for locking down the high pressure wellhead with a conductor wellhead housing, the lockdown tool comprising:

a housing comprising:

a conductor wellhead housing facing surface designed to come in contact with the conductor wellhead housing positioned at or near the seafloor;

a lockdown mechanism facing surface designed to come in contact with a lockdown mechanism that is at least partially positioned between the conductor wellhead housing and a high pressure wellhead seated in the conductor wellhead housing; and a wellhead facing surface having a profile that matches a profile of the high pressure wellhead formed on an outer surface of the high pressure wellhead;

a piston positioned in a cavity of the housing; and a hydraulic pressure port extending through a wall of the housing for applying hydraulic pressure by an external hydraulic pressure source into the cavity of the housing.

19. The system of claim 18, wherein the lockdown tool further comprises a first seal positioned between the piston and a first wall of the housing, and a second seal positioned between the piston and a second wall of the housing and wherein the first seal and the second seal are positioned to prevent hydraulic fluid from reaching a space above the piston.

20. The system of claim 18, wherein the lockdown tool further comprises a profile on the wellhead facing surface of the housing, wherein the profile on the wellhead facing surface of the housing matches a profile on an external surface of the high pressure wellhead to exert an upward force on the high pressure wellhead.

* * * * *